United States Patent [19]

Lemper

[11] Patent Number: 4,678,167

[45] Date of Patent: Jul. 7, 1987

[54] TUNDISH CAR IN A CONTINUOUS CASTING ASSEMBLY

[75] Inventor: Herbert Lemper, McMurray, Pa.

[73] Assignee: Kabushiki Kaisha Kobe Seiko Sho, Kobe, Japan

[21] Appl. No.: 833,112

[22] Filed: Feb. 26, 1986

[51] Int. Cl.[4] ..... C21B 3/10

[52] U.S. Cl. ..... 266/165; 266/276

[58] Field of Search ..... 266/165, 276; 222/604; 214/1 D, 1 R; 164/335, 337; 105/247, 177

[56] References Cited

U.S. PATENT DOCUMENTS 3,718,265 2/1973 Trost ..... 266/165

4,195,822 4/1980 Grochowski ..... 266/165

*Primary Examiner*—Melvyn J. Andrews

*Assistant Examiner*—S. Kastler

*Attorney, Agent, or Firm*—Oblon, Fisher, Spivak, McClelland & Maier

[57] ABSTRACT

A tundish car in a continuous casting assembly which includes wheel supporting frames for supporting a pair of front wheels and a pair of rear wheels, and lift mechanisms respectively mounted above the wheel supporting frames, two pairs of the wheel supporting frames being connected respectively through interwheel frames, each right and left pair of the lift mechanisms being connected through a lift frame which supports a tundish.

8 Claims, 4 Drawing Figures

TUNDISH CAR IN A CONTINUOUS CASTING ASSEMBLY

BACKGROUND OF THE INVENTION

1. Field of the Invention

The present invention relates to a tundish car in a continuous casting assembly.

2. Discussion of the Background

In a tundish car which carries a tundish for supplying molten steel to a mold in a conventional continuous casting assembly, a travelling main frame and one or more lifting frames are constructed as separate components; wheels are attached to the travelling main frame, one at each of the four corners generally four lifting mechanisms are mounted in positions offset from the positions of the wheels. One or more lifting frames are supported on the lifting mechanism. The tundish is supported on the one or more lifting frames. No effort has generally been made to reduce the main frame bending forces by locating the lifting mechanisms directly above the wheels. This built in offset results in high bending forces, requiring a very heavy and substantial main frame.

SUMMARY OF THE INVENTION

It is the object of the present invention to provide a tundish car in a continuous casting assembly capable of eliminating the need for an excessively large and heavy main frame and eliminating the need for the commonly used one or more lifting frames.

In order to achieve the above object, a tundish car in a continuous casting equipment according to the present invention is characterized by including wheel supporting brackets for supporting a pair of wheels on the operator side and a pair of rear wheels on the opposite side, and lift mechanisms respectively mounted just above the wheel supporting frames, two pairs of the wheel supporting frames being connected respectively through frames, both the right and left pair of the lift mechanisms being connected through a lifting main frame which supports a tundish.

Thus according to the present invention, the lift mechanisms are provided just above the wheel supporting brackets to eliminate an eccentric load and therefore an excessively heavy lifting main frame is no longer needed, it being sufficient to merely provide frames of a simple structure for connecting wheel supporting frames in front and rear positions, i.e., a simpler frame structure is attained and the conventionally used separate lifting frames are eliminated. Moreover, since it is not necessary to offset a lift device from each wheel supporting bracket, it is possible to utilize a short wheelbase and obtain a tundish car of a compact construction. In other words, the entirety of the molten steel handling assembly can be made compact.

In accordance with the present invention, the tundish cars are designed to travel on rails at a right angle to the casting direction. The cars will be positioned in pouring position by the operator. The tundish is placed onto and removed from the tundish car by an overhead crane.

In order to develop a tundish car which is new, compact and less expensive than conventional tundish cars, the following requirements were set:

1. Access to the mold from at least three sides.
2. Elimination of as many parts as possible to reduce cost.

3. Compact design to reduce cost.
4. Fast tundish lift—approx. 1 inch/second.

In order to accomplish the above requirements, a car was developed which consists of a lifting frame and extendable legs instead of the conventionally used mainframe with lifting frames that are supported on jack screws.

The main part of this tundish car is the actual lifting frame on which the tundish is supported. This frame is equipped with four slidably mounted vertical columns, one at each corner. The lower extensions of these columns carry the wheel assemblies. Above these columns are four ball screw jacks driven by two A.C. motors. These jacks extend the columns downward to raise the lifting frame and with it the tundish.

The advantage of this arrangement, besides the elimination of the conventional car frame, is that the lifting jacks and their drive motors are lifted with the tundish away from any metal spill or possible damage. The whole car is very compact and light compared to conventional tundish cars. Manually operated hydraulic jack cylinders will be provided to align both tundish nozzles to their respective molds. Tundish supports opposite the operator side are on rollers to permit heat expansion.

The tundish is closely guided to assure proper alignment with the tundish car. Because the tundish vessel is generally symmetrical, only two load cells are utilized on the drive side to give proper metal level information while casting. The car may be equipped with a single wheel supported launder which will protect the tundish car rails in case the ladle has to be moved with an open slide gate toward the emergency ladle.

BRIEF DESCRIPTION OF THE DRAWINGS

Other objects and features of the present invention will become more apparent from the following detailed description of an embodiment of the invention taken in connection with the accompanying drawings, in which.

DESCRIPTION OF THE PREFERRED EMBODIMENT

Figure 1:
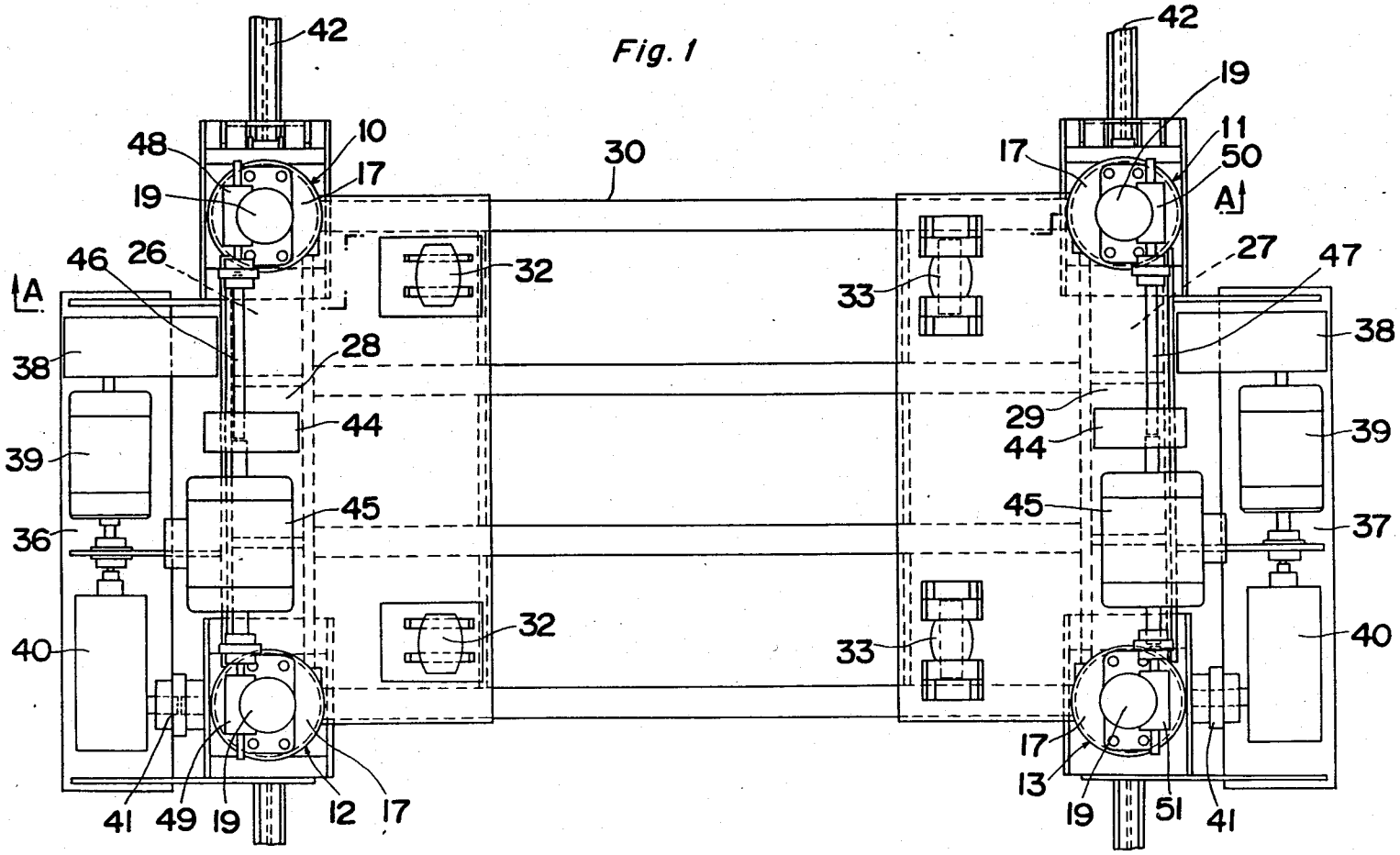
FIG. 1 is a plan view of a tundish car in a continuous casting assembly according to an embodiment of the present invention.
Figure 2:
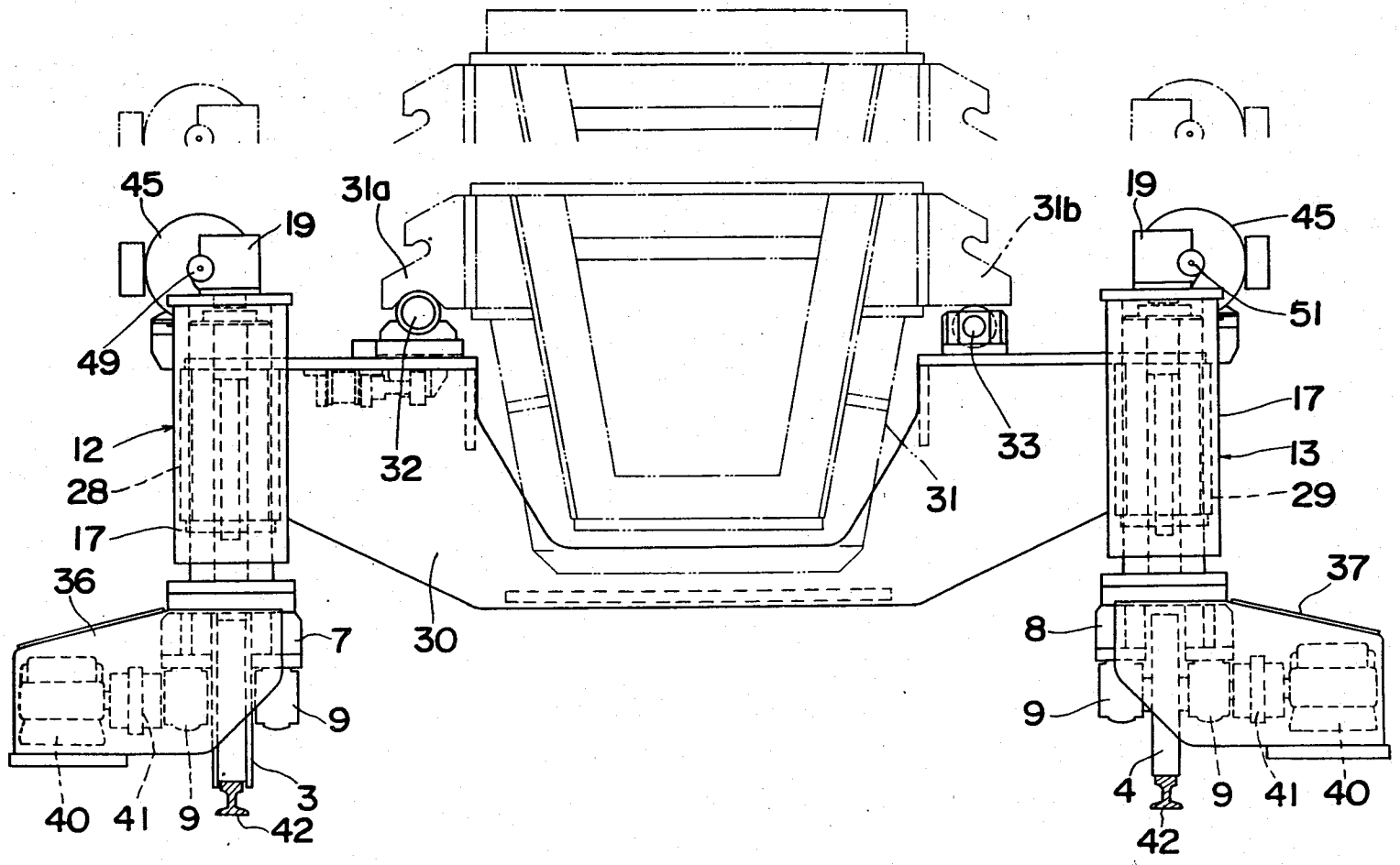
FIG. 2 is a front view thereof.
Figure 3:
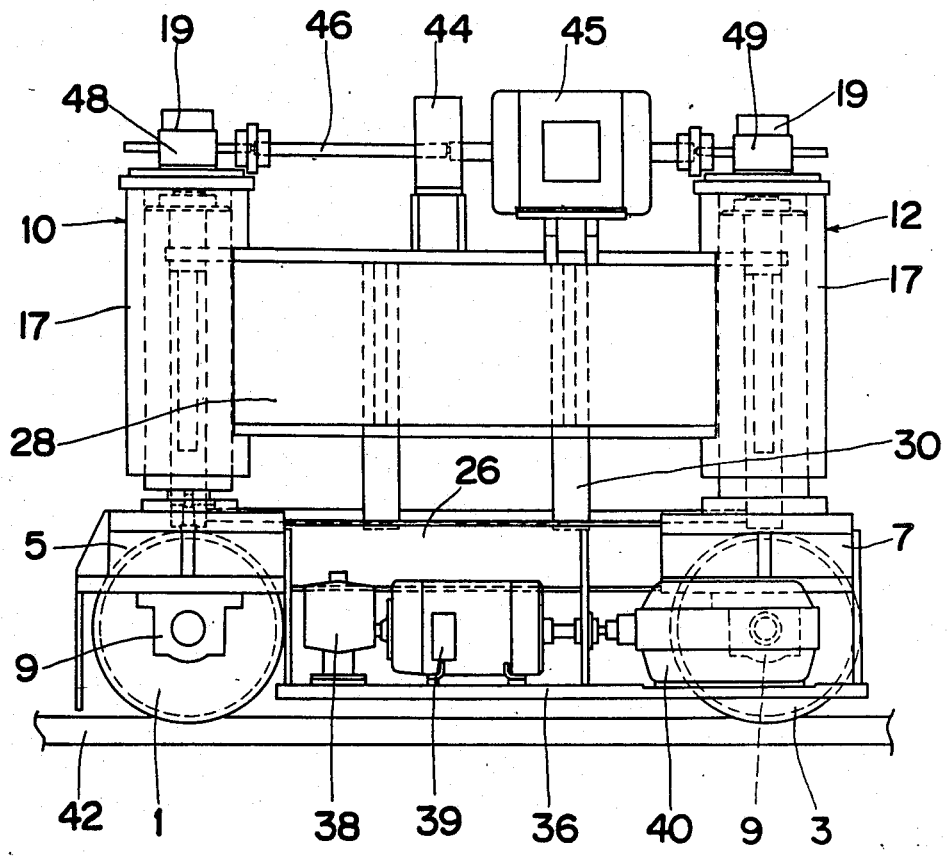
FIG. 3 is a side view thereof.

In a tundish car in a continuous casting assembly, as shown in FIGS. 1 to 3, there are provided a left front wheel 1, a right front wheel 2, a rear left wheel 3 and a rear right wheel 4, and axle portions of the wheels 1–4 are rotatably supported by bearings 9 which are fixed to lower surfaces of wheel supporting frames 5 and 6. Just above the wheel supporting frames 5 and 6 are provided lift mechanisms 10 to 13, respectively.

Figure 4:
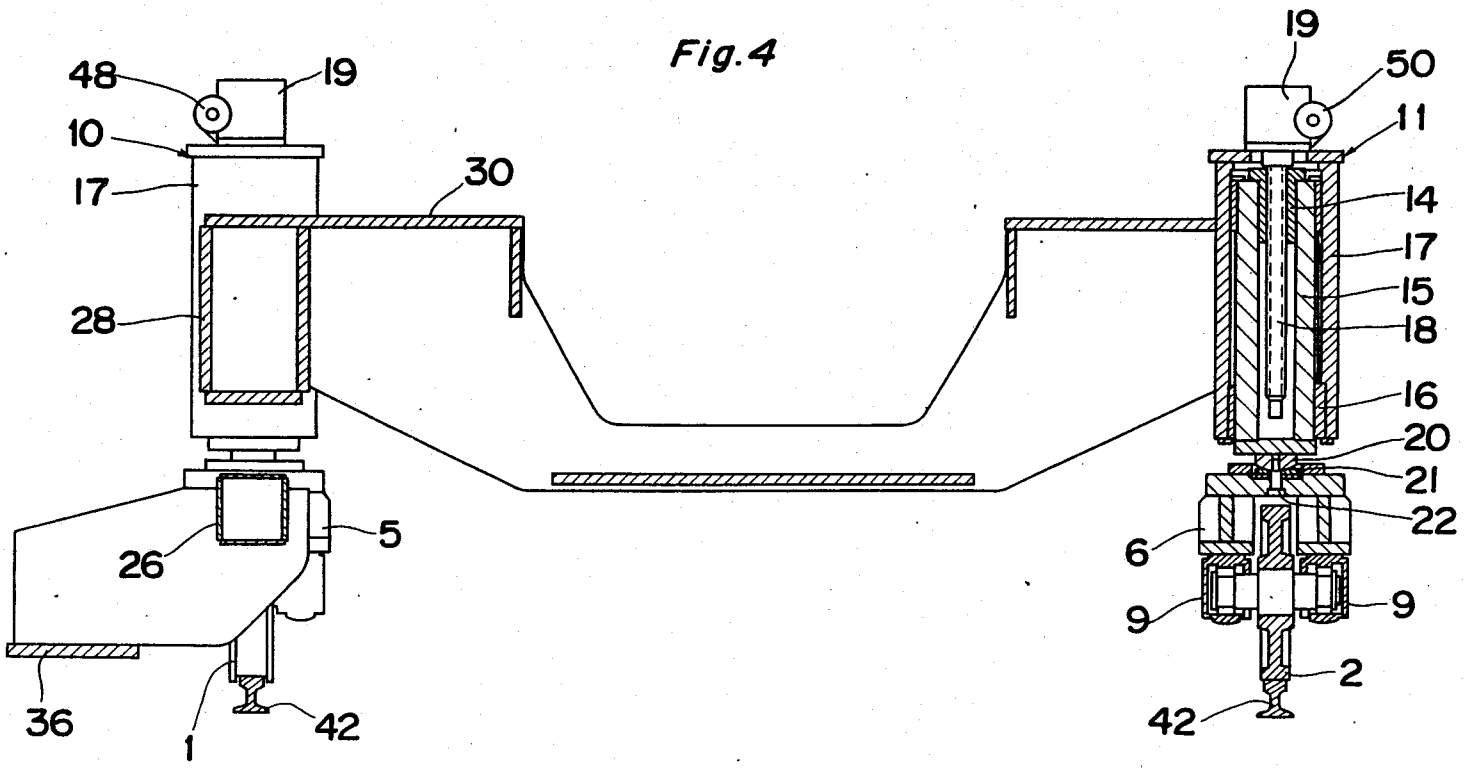
FIG. 4 is a sectional view taken along line A—A of FIG. 1.

As shown in FIG. 4, the lift mechanisms 10–13 are each provided with a vertical column extending upwardly from wheel support frames 5, 6 with an internally threaded sleeve 14 fixed to an upper portion thereof and a sleeve portion 17 of a lifting main frame 30 surrounding the guide shaft member 15 so as to be vertically movable, the verticle column 15 being secured against rotation with a key 16 extending inward from sleeve portion 17. On top of the portion 17 is mounted a ball screw jack 19 which has housed therein a worm wheel (not shown) and is provided at the upper portion of a screw shaft 18, the screw shaft 18 being threadedly fitted in the internally threaded sleeve 14. A screw jack is shown which is formed by the screw shaft 18, the worm wheel and a later-described worm.

A spherical plate 20 is fixed to the bottom of the vertical column 15 and a spherical seat 21 is fixed only to the top of each end of wheel supporting frame housing 6. The spherical plate 20 as supported by the spherical seat 21 is tiltably mounted with respect to the spherical seat 21 by means of a bolt 22 provided on the bottom of the spherical seat 21. Only wheel 1 and wheel 2 are seated in frames 5, 6 which are equipped with spherical seats for self alignment. Frames 5, 6 at wheels 3 and 4 are solidly attached by means of bolted flange connections to the vertical guide columns 15. The lift sleeve portion 17 of the lift mechanism 10 on the side of the left front wheel 1 and the sleeve portion 17 of the lift mechanism 12 on the side of the left rear wheel 3 are connected through a fabricated box member frame 28 of the lifting main frame 30. While the sleeve portion 17 of the lift mechanism 11 on the side of the right front wheel 2 and the sleeve portion 17 of the lift mechanism 13 on the side of the right rear wheel 4 are connected through a fabricated box member frame 29, the frames 28 and 29 being connected through the lifting main frame 30. On an upper surface of the lifting main frame 30 are provided left and right receiving means 32 and 33 for receiving left and right plate extensions 31*a* and 31*b* of a tundish 31. To side portions of the fabricated box frame 26 and fabricated box frame 27 are fixed motor supporting frames 36 and 37, respectively, and a brake 38, electric motor 39, reduction gear 40 and coupling 41 are attached to each of the motor supporting frames 36 and 37, the couplings 41 being connected to the left and right rear wheels 3, 4. Consequently, the left and right rear wheels 3, 4 are rotated on rails 42 by the electric motors 39.

A brake 44 and an electric motor 45 are attached to the main frame 30 via an upper surface of each of the frames 28 and 29. To a front part of a left motor shaft 46 is fixed a worm 48 which is in mesh with the worm wheel of the left front lift mechanism 10, and to a rear part of the left motor shaft 46 is fixed a worm 49 which is in mesh with the worm wheel of the left rear lift mechanism 12. On the other hand, to a front part of a right motor shaft 47 is fixed a worm 50 which is in mesh with the worm wheel of the right front lift mechanism 11, and to a rear part of the right motor shaft 47 is fixed a worm 51 which is in mesh with the worm wheel of the right rear lift mechanism 13. Therefore, when the screw shafts 18 of the lift mechanisms 10–13 are rotated by the electric motors 45, the sleeve portions 17 rise up so as to raise the lift frame 30.

The following description is provided regarding operation of the tundish car in the continuous casting assembly. Upon turning ON the electric motors 39 mounted to the left and right motor supporting frames 36 and 37, the left and right rear wheels 3, 4 are rotated through reduction gears 40 and couplings 41 and the tundish car moves on the rails 42 up to a required position.

Next, when the electric motors 45 are turned ON, the screw shafts 18 are rotated through motor shafts 46, 47, worms 48–51 and worm wheels and the sleeve portions 17 of the lift mechanisms 10–13 move vertically, so that the lifting main frame 30 is vertically moved by a predetermined stroke. Where the tundish 31 is received and supported by the receiving means 32, 33 on the lifting main frame 30, its load is borne by the wheel supporting brackets 5, 6 through the lift mechanisms 10–13.

Therefore, there is no eccentric load as occurs in prior art devices and thus becomes unnecessary to provide a strong frame. It suffices to merely provide the frames 26, 27 of a simple structure.

Although one embodiment of the present invention has been described in detail, it is to be understood that the invention is not limited thereto and that such modifications and alterations as can be easily effected by those skilled in the art are included in the invention within the scope of the technical concept described in the scope of the appended claims.

What is claimed as new and desired to be secured by Letters Patent of the United States is:

1. A tundish car in a continuous casting assembly, comprising:

a lifting main frame for supporting a tundish;

first and second wheel support frames for supporting a pair of front wheels and a pair of rear wheels;

a plurality of lift mechanisms respectively mounted above said wheel support frames and connected to said lifting main frame;

means for rigidly interconnecting a first and second lift mechanism of said plurality of lift mechanisms; and a spherical plate fixed to a bottom portion of at least one of said plurality of lift mechanisms and a spherical seat provided on at least one of said wheel support frames wherein said at least one of said plurality of lift mechanisms is supported on said spherical seat by engagement of said spherical seat with said spherical plate.

2. A tundish car as set forth in claim 1, further comprising means for tiltably mounting said spherical plate with respect to said spherical seat.

3. A tundish car as claimed in claim 1, wherein said at least one of said plurality of lift mechanisms comprises a pair of lift mechanisms.

4. A tundish car in a continuous casting assembly, comprising:

a lifting main frame for supporting a tundish;

first and second wheel support frames for supporting a pair of front wheels and a pair of rear wheels;

a plurality of lift mechanisms respectively mounted above said wheel support frames and connected to said lifting main frame; and means for rapidly interconnecting a first and second lift mechanism of said plurality of lift mechanisms wherein at least one of said lift mechanisms further comprises a sleeve portion, a vertical column extending upwardly from said wheel support frames and positioned in said sleeve portion, an internally threaded sleeve member positioned in said guide shaft mechanism, a rotatable screw shaft for engagement with said threaded sleeve member, and means mounted on an upper portion of said vertical column and connected to said screw shaft for rotating said screw shaft.

5. A tundish car in a continuous casting assembly according to claim 4, further comprising a spherical plate fixed to a bottom portion of at least one of said plurality of lift mechanisms and a spherical seat provided on at least one of said wheel support frames wherein at least one of said plurality of lift mechanisms is supported on said spherical seat by engagement of said spherical seat with said spherical plate.

6. A tundish car in a continuous casting assembly according to claim 4, wherein said means for rotating said screw shaft further comprises a ball screw jack.

7. A tundish car as set forth in claim 5, further comprising means for tiltably mounting said spherical plate with respect to said spherical seat.

8. A tundish car as set forth in claim 5, wherein said at least one of said plurality of lift mechanisms comprises a pair of lift mechanisms.

* * * * *